United States Patent [19]

Briggs et al.

[11] Patent Number: 4,896,793

[45] Date of Patent: Jan. 30, 1990

[54] LABELLING MACHINES

[75] Inventors: Peter D. S. Briggs, Taverham; Richard J. Hirst, Fakenham; Alan Constantine, Norwich, all of England

[73] Assignee: Sinclair International Limited, Norwich, England

[21] Appl. No.: 128,943

[22] Filed: Dec. 4, 1987

[51] Int. Cl.[4] ..... B65C 9/18; B65H 5/28

[52] U.S. Cl. ..... 221/73; 156/495; 156/541; 156/DIG. 33

[58] Field of Search ..... 156/541, 542, 577, DIG. 33, 156/495, 384, DIG. 48, DIG. 49, 584; 40/2 R; 221/73

[56] References Cited

U.S. PATENT DOCUMENTS

| | | | |
|---|---|---|---|
| 2,095,437 | 10/1937 | Fox | 40/2 R |
| 2,409,065 | 10/1946 | Pohl | 156/DIG. 33 |
| 3,158,522 | 11/1964 | Dreher | 156/519 |
| 3,764,447 | 10/1973 | Duff | 40/2 R |
| 4,217,164 | 8/1980 | La Mers | 156/541 |
| 4,301,729 | 11/1981 | Fujita | 156/384 |
| 4,352,710 | 10/1982 | Makley | 156/541 |

*Primary Examiner*—Michael Wityshyn
*Attorney, Agent, or Firm*—Fiddler & Levine

[57] ABSTRACT

A machine particularly for applying labels to non-uniform items such as fruit and vegetables, the labels being provided along a carrier strip and the carrier strip having profiled edges, said machine including means for separating the labels from the carrier, a profiled means, such as a profiled roller, engageable with the edges of the carrier to advance the carrier strip from a storage means to the separating means.

7 Claims, 3 Drawing Sheets

LABELLING MACHINES

This invention relates to a labelling machine and more particularly but not exclusively a machine for labelling non-uniform objects such as fruit and vegetables.

In our published European patent application No. 0113256 there is disclosed a labelling machine which comprises a cassette for a strip of labels. The strip is led from the cassette over a stripper plate where individual labels are separated and picked up by one of a plurality of bellows on a rotating applicator head. The label is held on the end of the bellows by suction until rotation of the head brings the bellows above an object to be labelled at which instant air is admitted to the bellows causing it to expand and bring the label into contact with the said object to be labelled.

In the specific arrangement described in the aforesaid European patent application No. 0113256 the label strip comprises a plurality of labels disposed at intervals along a release paper carrier. The label strip is led from the cassette over a first roller and around the edge of a stripper plate where the labels are separated from the carrier. The waste carrier is then led over sprocket roller means fixed on the same shaft as the first roller and which engage in perforations in the carrier. The aforesaid engagement of the sprocket roller means with the perforations in the carrier constitutes the means by which the strip is drawn from the cassette and advanced over the stripper plate for separation of the labels from the carrier. As the label strip passes over the stripper plate, prior to separation of the labels from the carrier, the label strip is led under a pressure plate which applies drag to the strip and maintains tension therein.

In setting up the labelling machine the separation of a label from the carrier must be synchronised with the arrival of a bellows on the rotating applicator head which is to receive the separated label. In addition he position of the label on the bellows is important since that determines whether the bellows will hold the label reliably during rotation of the applicator head and also determines whether the label will be properly applied by the bellows to an object to be labelled.

It has been found, also, that the advance of the label strip is controlled not only by the engagement of the sprocket roller with perforations in the tape but by a combination of that engagement and the friction between the label strip and the surfaces over which the label strip is drawn and with which the label strip engages. The aforesaid friction is a function, inter alia, of surface characteristics of the label strip. It has been found that these surface characteristics may vary as between different reels of label strip and sometimes even along the length of a single reel of strip. In addition to the variation in friction caused by the different surface characteristics of the strip, dirt and/or adhesive from the label strip can build up on the machine surfaces engaged by the label strip and that also will alter the friction as between the strip and these surfaces.

These fluctuations, which may be either an increase or decrease in friction, can cause the strip to move out of register with the sprocket roller so that labels are separated from the strip during the wrong part of the labelling cycle and are not reliably transferred to an object to be labelled. In some circumstances once this strip has moved out of register with the sprocket roller it remains in that condition and does not revert back to the correct setting. This behaviour causes very considerable operating problems. Not only must the machine be stopped in order to adjust the position of the label strip, but it has sometimes been found very difficult to correct the advance or retard of the strip from the appropriate setting.

It is an object of the present invention to overcome these problems.

According to one aspect of the invention there is provided a labelling machine comprising means for storing label strip, means for separating individual labels from the label strip and label strip advancing means for moving the label strip from the label strip storing means to the label separating means, drive means for the label advancing means, means for adjusting the label advancing means relative to the drive means said label advancing means including means for engaging a side edge of the label strip whereby movement of the advancing means causes a corresponding movement of the label strip.

By the invention the advance of the label strip is upstream of the place where the labels are separated from the strip. Any waste strip material remaining after the labels have been separated therefrom is preferably taken up on take-up means advantageously arranged to apply tension to the strip. Thus the strip disposition relative to an applicator which is to take up labels separated from the carrier can be adjusted in both forward and reverse directions. Moreover fine adjustment can be obtained by movement of the advancing means relative to the remainder of the assembly instead of adjustment of the strip relative to the advancing means.

A specific embodiment of the invention will now be described by way of example with reference to the accompanying drawings in which:

FIG. 1 is a side elevation of a part of a cassette assembly for advancing label strip and separating labels from the strip;

FIG. 1*a* is a side elevation of the whole of the assembly of FIG. 1 but on a reduced scale;

The labelling machine of this invention is of the general type that is described in detail in our aforesaid European patent application No. 0113256 and consists of a cassette for supplying label strip and separating labels from the strip removably mountable on the labelling machine proper which includes a rotary head for picking up separated labels from the cassette and applying them to objects to be labelled. The present invention is principally concerned with the cassette and, therefore, the other parts of the labelling machine will not be described in detail.

Figures 1, 1A:
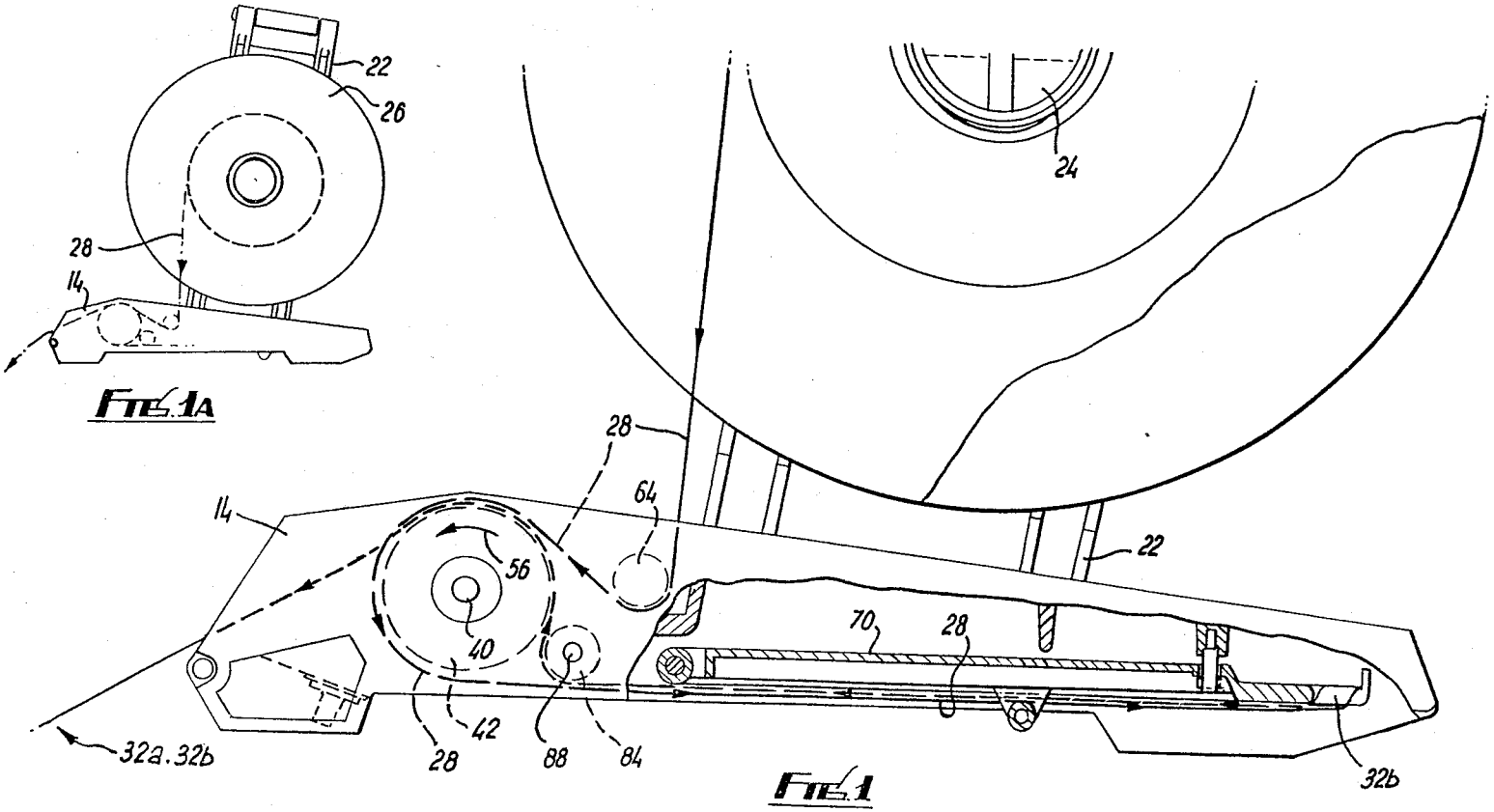
Figure 2:
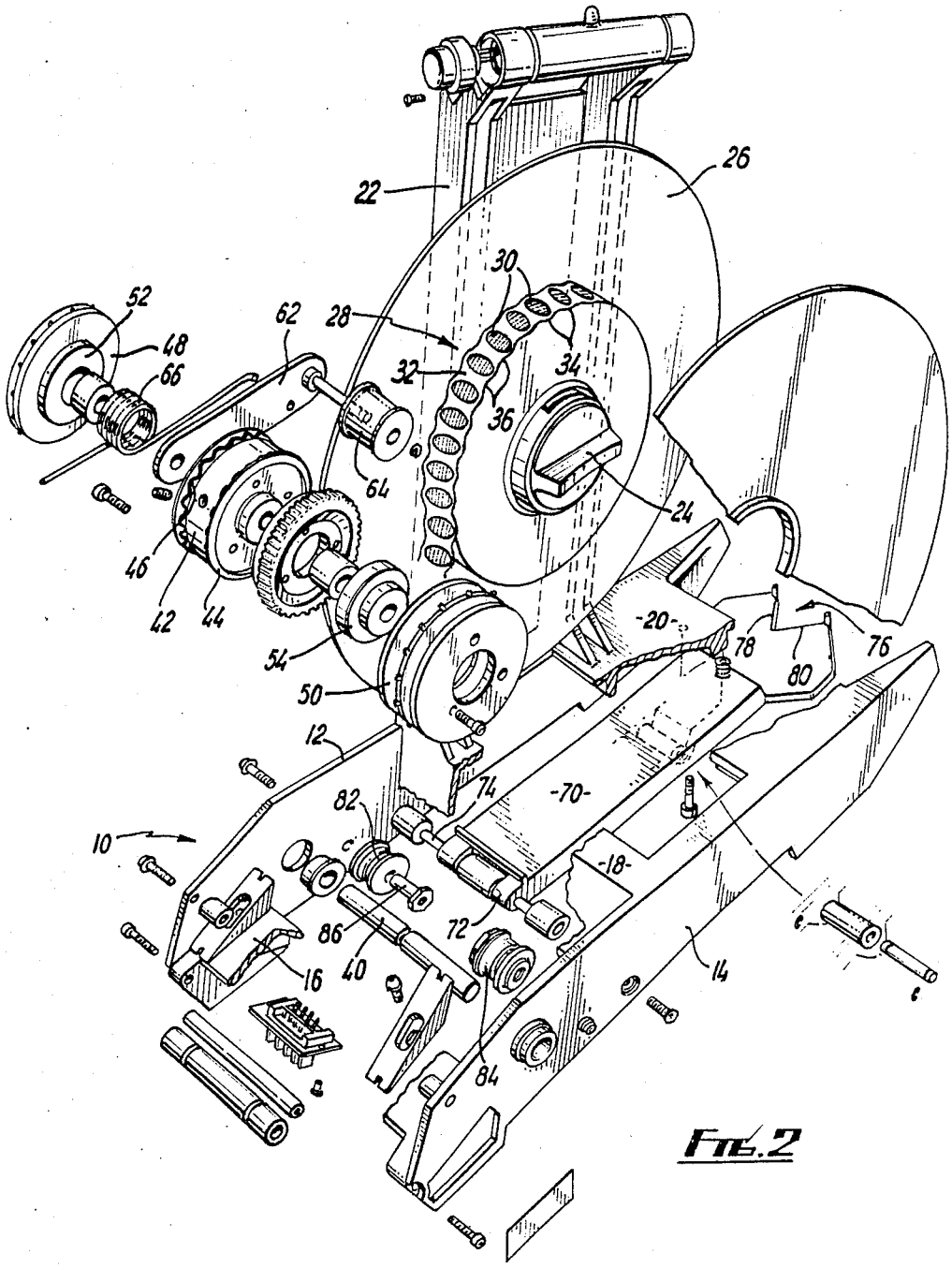
FIG. 2 is an exploded view of the cassette.
Figure 3:
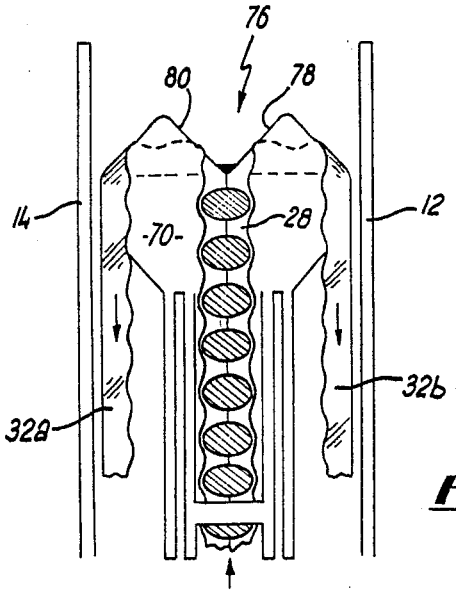
FIG. 3 is an underplan view of the stripper plate.

Referring to FIGS. 1 and 2 the cassette comprises a frame, generally 10, having two parallel spaced apart arms 12, 14 linked by transverse struts 16, 18, 20. A support 22 extends upwardly from arm 12 and carries a hub 24 for rotatably supporting a reel 26 having a label strip 28 wound thereon.

In the embodiment being described the label strip comprises a plurality of labels 30 with pressure sensitive adhesive on their underside, disposed at uniform intervals along a release paper carrier 32. The carrier is split along the longitudinal centre line thereof so as to be separable into two separate strips. The edges of the carrier are profiled in a sinusoidal manner with the peaks 34 and troughs 36 on opposite sides being transversely in register so as to form a succession of alternately enlarged and reduced width carrier portions. The labels 30 are disposed substantially in the enlarged width portions and extend over the split centre line of the carrier.

A shaft 40 extends across the frame arms 12, 14 and carries at its centre a label strip feed roller 42. The roller 42 has radially projecting flanges 44 on either side, the inwardly facing surfaces 46 being profiled in a sinusoidal manner corresponding to the profiling along the edge of the label strip.

The shaft 40 also carries two sprocket wheels 48, 50 one on either side of the feed roller 42. The wheels 48 and 50 are not mounted directly on shaft 40 but are fitted on hubs 52, 54 which permit over-run of the wheels in the direction indicated by arrow 56 in FIG. 1. Shaft 40 is rotated by means of a gear 58 which, when the cassette is mounted on the rest of the machine, meshes with gear 60 (FIG. 4) driven by the machine main drive (not shown).

An arm 62 is also mounted on shaft 40 but not for rotation therewith. The free end of arm 62 carries a tension roller 64 for the label strip and the arm is biassed appropriately by coil spring 66.

A stripper plate 70 is pivotally mounted at one end 72 thereof on a shaft 74 extending between frame arm 12, 14. The free end of the plate 70 is formed with a V shaped notch 76 defining stripping edges 78 and 80. Adjacent the end 72 of the stripping plate guide rollers 82, 84 are mounted on shafts 86, 88 fixed in the arms 12, 14. The guide rollers 82 and 84 are aligned with the sprocket wheels 48 and 50 respectively.

In use the label strip 28 is led from the reel 26 around tension roller 64 and over feed roller 42 with the profiled edges of the strip engaged in the profiling 46 on the roller 42. The strip 28 then passes under the stripper plate 70. When the strip reaches the notch 76 the carrier is divided along the slit centre line into two waste strips **32*a* and 32*b*. The strips 32*a* and 32*b* are led over the upper surface of the stripper plate and then returned along the undersurface of the stripper plate parallel, but in the opposite direction to the intact strip 28. The waste strips pass over guide rollers 82 and 84 and are then picked up by the sprocket wheels 48 and 50**.

When the cassette is mounted in the labelling machine so that gear 58 meshes with drive gear 60 rotation of shaft 40 causes the feed roller 42 to rotate and positively feed the label strip 28 from the reel 26 and over the stripper plate 70. As the strip passes over the notch 76 and the carrier is divided the labels are freed from the carrier and move into the space 76 where they are picked up by an applicator such as described in our said European patent application No. 0113256. The waste carrier strips **32*a* and 32*b* are then conveyed away by the sprocket wheels 48 and 50 which are also rotated by shaft 40. Tension in the waste carrier portions and the label strip between the feed roller and the notch 76 is maintained because the feed roller positively controls the advance of the label strip and because there is slight over-run of the sprocket wheels at the end of each cycle of operation of the machine as a whole achieved by virtue of the free wheel hubs 52 and 54**.

Figure 4:
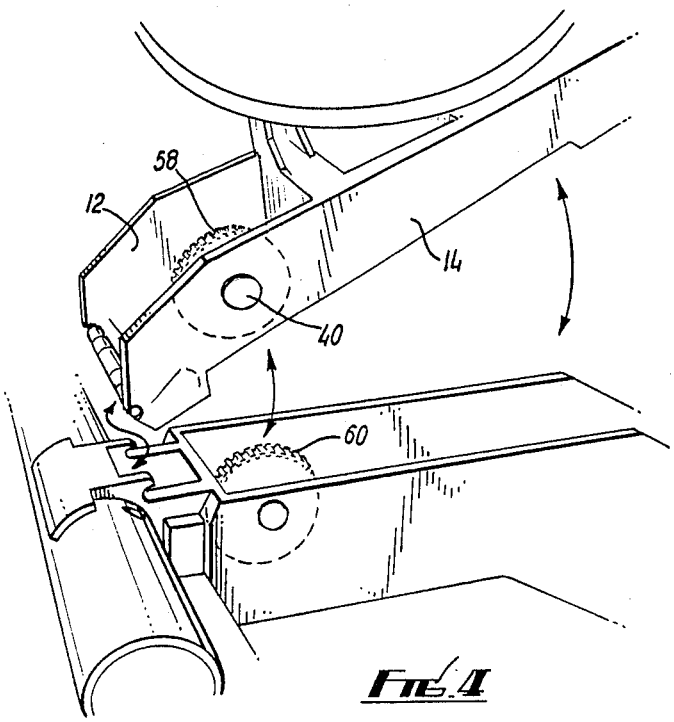
FIG. 4 shows diagrammatically the connection between the cassette and the rest of the labelling machine including the drive means.

The forwarding of the label strip by the machine of the invention is unaffected by any variation in the friction between the surface of the strip and the machine surfaces engaged or contacted by the flat surfaces of the strip. If the position of the label release from the label strip relative to the cycle of operation of the machine as a whole needs to be adjusted this is quite easily done by lifting the cassette as illustrated in FIG. 4 so that gears 58 and 60 are disengaged. Shaft 40 can then be rotated in either direction so as to advance or retard the label release from the label strip. The limit on the minimum adjustment is solely controlled by the spacing between the teeth on the gears 58 and 60. In this connection although the embodiment just described has sprocket wheels 48 and 50 for the waste strips **32*a* and 32*b*** the engagement of those sprocket wheels with the waste carrier is quite random and has no effect on the adjustment of the label release from the label strip.

The invention is not restricted to the specific embodiment just described. Many variations and modifications are possible.

We claim:

1. A labelling machine comprising cassette means for storing a reel of label strip, said label strip comprising: a label carrier strip having a line of longitudinal weakening permitting separation of the carrier strip into two strips; labels disposed at intervals on the carrier strip, said labels spanning the longitudinal weakening, said label strip having a profiled edge; a stripper plate for separating individual labels from the carrier strip; feed roller means for advancing the labels strip over the stripper plate, said feed roller means having a profiled surface which engages the profiled edge of the label strip for advancement in a first direction of advancement of the label strip relative to the stripper plate around the edge of the stripper plate for separation of individual labels from the carrier strip and for separation of the carrier into two carrier strips along the longitudinal weakening thereof and for advancing the separated carrier strips relative to the stripper plate in a second direction, said second direction being opposite to the first direction, said feed roller means being located upstream of the stripper plate; a first take-up roller for receiving one separated carrier strip; a second take-up roller for receiving the other separated carrier strip; free wheel hubs supporting said first and second take-up rollers permitting overrun when taking up the separated carrier strips whereby tension is maintained in said label strip passing over the stripper plate; drive means for the feed roller means and the first and second take-up rollers, said drive means being separably connected to the feed roller means and the first and second take-up rollers whereby the disposition of the feed roller means can be adjusted relative to the drive means.

2. A labelling machine comprising: means for storing label strip; means for separating individual labels from the label strip; label strip advancing means for moving the label strip from the label strip storing means to the label separating means; drive means for said label strip advancing means; means for adjusting the label strip advancing means relative to the drive means, said label strip advancing means being located upstream of the separating means and said label strip advancing means including means for engaging a side edge of the label strip whereby movement of the advancing means causes a corresponding movement of the label strip; means for forwarding waste material from said label strip after separation of labels from said strip, said means for forwarding waste material comprising roller means provided with means engageable with the waste material at random locations, said roller means being mounted on free wheel hubs for free rotation in one direction whereby said roller means maintains tension in said waste material between said label separating means and said roller means.

3. A labelling machine as claimed in claim 2, wherein the label strip advancing means comprises a roller having a profiled surface and wherein the label strip has a profiled edge engageable by the profiled surface on the label strip advancing means.

4. A labelling machine as claimed in claim 3, wherein the label strip has a sinusoidal edge profile and the profiled surface on the roller has a complementary shape.

5. A labelling machine as claimed in claim 3, wherein said profiled surface is provided on flanges at the sides of said roller, said profiled surface on said flanges being directed towards each other.

6. A labelling machine as claimed in claim 2, wherein the means for forwarding the waste material applies tension to the said waste material and to the carrier strip between the label strip advancing means and the means for forwarding the waste material.

7. A labelling machine as claimed in claim 2, wherein the means engageable with the waste material comprises sprocket means.

* * * * *